US009660405B2

(12) United States Patent
Carstensen et al.

(10) Patent No.: US 9,660,405 B2
(45) Date of Patent: May 23, 2017

(54) ELECTRICAL DEVICE WITH LOW FRICTION CONTACT PARTS

(71) Applicant: ABB Schweiz AG, Baden (CH)

(72) Inventors: Hauke Carstensen, Bälinge (SE); Björgvin Hjörvarsson, Knivsta (SE); Max Wolff, Knivsta (SE); Vassilios Kapaklis, Uppsala (SE)

(73) Assignee: ABB Schweiz AG, Baden (CH)

( * ) Notice: Subject to any disclaimer, the term of this patent is extended or adjusted under 35 U.S.C. 154(b) by 0 days.

(21) Appl. No.: 15/304,450

(22) PCT Filed: Apr. 24, 2015

(86) PCT No.: PCT/EP2015/058928

§ 371 (c)(1),
(2) Date: Oct. 14, 2016

(87) PCT Pub. No.: WO2015/169622

PCT Pub. Date: Nov. 12, 2015

(65) Prior Publication Data

US 2017/0040765 A1 Feb. 9, 2017

(30) Foreign Application Priority Data

May 7, 2014 (EP) ..... 14167341

(51) Int. Cl.
*H01R 39/00* (2006.01)
*H01R 41/00* (2006.01)
(Continued)

(52) U.S. Cl.
CPC ..... *H01R 39/646* (2013.01); *H01F 1/447* (2013.01); *H01R 39/08* (2013.01); *H01R 39/20* (2013.01);
(Continued)

(58) Field of Classification Search
CPC ..... H01R 39/646; H01R 39/59; H01R 39/30; H01R 39/52; H01R 39/48; H01R 39/08; H01F 1/447; H01F 1/44
(Continued)

(56) References Cited

U.S. PATENT DOCUMENTS 4,284,918 A * 8/1981 Cannell ..... H01R 39/30 310/178
5,361,012 A * 11/1994 Hildebrandt ..... H01R 39/48 310/228
(Continued)

FOREIGN PATENT DOCUMENTS

DE 102007058738 A1 6/2009
JP 2001185261 A 7/2001
(Continued)

OTHER PUBLICATIONS

International Search Report and Written Opinion of the International Searching Authority Application No. PCT/EP2015/058928 Jun. 16, 2015;Mailing Date:Jun. 23, 2015 11 pages.

*Primary Examiner* — Felix O Figueroa
(74) *Attorney, Agent, or Firm* — Whitmyer IP Group LLC

(57) ABSTRACT

An electrical device including an electrode arrangement having a magnet, and an electrode, an electrically conducting movable device, movable relative to the electrode arrangement and spaced apart from the electrode arrangement, whereby a gap (G) is formed therebetween, and a suspension including a liquid, a plurality of magnetic particles dispersed in the liquid and a plurality of non-magnetic electrically conducting particles dispersed in the liquid, which non-magnetic electrically conducting particles have higher electric conductivity than the magnetic particles, wherein the suspension) extends between the electrically movable device and the electrode arrangement in the gap (G), and wherein the magnet is arranged to provide a magnetic field through the suspension to thereby align the non-magnetic electrically conducting particles between the electrode arrangement and the electrically conducting mov-
(Continued)

able device to obtain an electrical connection between the electrode arrangement and the electrically conducting movable device.

15 Claims, 1 Drawing Sheet

(51) Int. Cl.

| | |
|---|---|
| ***H01R 39/64*** | (2006.01) |
| ***H01F 1/44*** | (2006.01) |
| ***H01R 39/20*** | (2006.01) |
| ***H01R 39/59*** | (2006.01) |
| ***H01R 39/08*** | (2006.01) |
| ***H01R 39/48*** | (2006.01) |
| ***H01R 39/52*** | (2006.01) |
| ***H01R 39/30*** | (2006.01) |

(52) U.S. Cl.
CPC ..... *H01R 39/30* (2013.01); *H01R 39/48* (2013.01); *H01R 39/52* (2013.01); *H01R 39/59* (2013.01)

(58) Field of Classification Search
USPC ..... 439/5, 179, 38
See application file for complete search history.

(56) References Cited

U.S. PATENT DOCUMENTS

| | | | | |
|---|---|---|---|---|
| 6,543,781 | B1 | 4/2003 | Rehm et al. | |
| 7,573,174 | B2 * | 8/2009 | Braml | H01R 39/48 310/239 |
| 7,601,281 | B2 * | 10/2009 | Masaki | H01R 43/007 264/108 |
| 2006/0065995 | A1 | 3/2006 | Masaki et al. | |

FOREIGN PATENT DOCUMENTS

| | | | |
|---|---|---|---|
| JP | 2005222826 | A | 8/2005 |
| RU | 2441309 | C1 | 1/2012 |
| WO | 2004088695 | A1 | 10/2004 |
| WO | 2015169622 | A1 | 11/2015 |

* cited by examiner

ELECTRICAL DEVICE WITH LOW FRICTION CONTACT PARTS

TECHNICAL FIELD

The present disclosure generally relates to electrical devices. In particular it relates to an electrical device comprising an electrode, an electrically conducting device movable relative to the electrode, and electrical conducting means adapted to conduct current between the electrode and the electrically conducting device.

BACKGROUND

Electrical devices such as electrical motors may comprise an electrically conducting rotatable device, for example a commutator or slip ring, which connects to rotor windings of a rotor arranged inside a stator. Commutators for example, are in mechanical contact with brushes while rotating, enabling current to flow through the commutator to the rotor windings. The brushes are typically made of carbon, sometimes with copper particles dispersed in the carbon to increase conductivity. Due to mechanical friction the brushes are eventually worn down, and electrically conducting particles coming loose from the brushes due to wear may spread inside the stator, increasing the risk of short circuiting the electrical device. It would hence from at least two aspects be desirable to decrease the mechanical wear of brushes.

WO2004/088695 discloses a device for making or breaking electric contact between two electrodes for example in an electrical motor, to replace the commutator brush. The device comprises magnetic nanostructures dispersed in a dielectric liquid between the two electrodes, and a controllable magnetic field means to control the movement of the magnetic nanostructures. The magnetic nanostructures may thus be aligned depending on the magnetic field, in order to provide current flow between the two electrodes.

Magnetic nanostructures are however not ideal electrical conductors. Although WO2004/088695 discloses that the magnetic nanostructures may comprise an electrically conducting coating, a coating process of nanostructures may be difficult to control to obtain optimal coating thickness. There is furthermore a contact resistance between each pair of nanoparticles which due to the relative hardness of the magnetic nanoparticles and the large number of contact resistances due to the small size of the nanoparticles, leads to significant losses.

SUMMARY

In view of the above an object of the present disclosure is thus to provide an electrical devices which solves or at least mitigates the problems of the prior art.

There is hence provided an electrical device comprising: an electrode arrangement comprising a magnet and an electrode, an electrically conducting movable device, movable relative to the electrode arrangement and spaced apart from the electrode arrangement, whereby a gap is formed therebetween, and a suspension comprising a liquid, a plurality of magnetic particles dispersed in the liquid and a plurality of non-magnetic electrically conducting particles dispersed in the liquid, which non-magnetic electrically conducting particles have higher electric conductivity than the magnetic particles, wherein the suspension extends between the electrically movable device and the electrode arrangement in the gap, and wherein the magnet is arranged to provide a magnetic field through the suspension to thereby align the non-magnetic electrically conducting particles between the electrode arrangement and the electrically conducting movable device to obtain an electrical connection between the electrode arrangement and the electrically conducting movable device.

The effective magnetic behaviour of the non-magnetic electrically conducting particles is altered because they replace the mixture of liquid and magnetic particles in a certain volume. This effect can be seen as analogue to the Archimedes principle. The non-magnetic electrically conducting particles are diamagnetic particles which have negative magnetic susceptibility. The effective magnetic susceptibility of a non-magnetic electrically conducting particle is defined as the magnetic susceptibility of the non-magnetic electrically conducting particle minus the magnetic susceptibility of displaced liquid including the dispersed magnetic particles, within the volume of the non-magnetic electrically conducting particle. By means of this altering of the magnetic susceptibility of the non-magnetic electrically conducting particles, they may come to behave like magnetic particles in the suspension when subjected to an external magnetic field. The non-magnetic electrically conducting particles may in an external magnetic field thereby be aligned between the electrode arrangement and the electrically conducting movable device. This alignment enables current to flow between the electrode arrangement, in particular the electrode, and the electrically conducting movable device through the suspension via the non-magnetic electrically conducting particles.

Compared to prior art solutions which utilise a mechanical connection to transmit current from an electrode to an electrically conducting movable device, friction and wear may be significantly reduced. Furthermore, compared to WO2004/088695 lower loss current conduction may be provided.

The concentration of the magnetic particles in the liquid is one parameter which determines the magnetic properties of the non-magnetic electrically conducting particles. Another parameter which determines the magnetic properties of the non-magnetic electrically conducting particles is the magnetic moment of the magnetic particles. A third parameter which determines the magnetic properties of the non-magnetic electrically conducting particles is the magnetic field strength. Thus, for example for a specific magnetic field strength the same effective magnetic susceptibility may be obtained by reducing the amount of magnetic particles by half and selecting magnetic particles with twice the magnetic moment. According to another example, a given effect may be obtained at half the magnetic field strength if the magnetic moment per magnetic particle is increased by a factor 2.

According to one embodiment the magnetic particles are smaller in size than the non-magnetic electrically conducting particles.

According to one embodiment the magnetic particles are at least an order of magnitude smaller in size than the non-magnetic electrically conducting particles.

According to one embodiment the non-magnetic electrically conducting particles are micrometer-sized. By means of micrometer-sized non-magnetic particles fewer contact resistances created at the contact between each pair of non-magnetic particle will be obtained, which results in reduced losses.

According to one embodiment the non-magnetic electrically conducting particles are made of one of the group of copper, silver, gold, aluminium, and conducting ceramic.

The exemplified electrically conducting materials are softer than for example ferromagnetic materials, which enable the non-magnetic electrically conducting particles to deform such that the surfaces of contact between adjacent non-magnetic electrically conducting particles increases when arranged in ordered lattices. The contact resistivity may thereby further be reduced.

According to one embodiment the liquid is an oil or water. Oils are non-corrosive and typically have a low viscosity, which reduces friction between the fixed part and the rotating part of the electrical device, i.e. the electrode and the electrically conducting movable device. In general, any low viscosity, preferably non-corrosive, liquid may be utilised as liquid base for the suspension.

According to one embodiment the magnetic particles are nanometer-sized.

According to one embodiment the liquid and the magnetic particles form a ferrofluid.

According to one embodiment the suspension has a magnetic susceptibility which is non-zero. Similarly to the previous discussion concerning the magnetic properties of the non-magnetic electrically conducting particles, the susceptibility of the suspension may vary, as there is a plurality of parameters determining the behaviour of the non-magnetic electrically conducting particles. If for example the susceptibility of the suspension is reduced to half of its original value, e.g. by dilution or by utilising other type of magnetic particles, and the electric field applied to the suspension is doubled, the same effect will be obtained.

One embodiment comprises a container enclosing the electrically conducting movable device and the suspension.

According to one embodiment the electrically conducting movable device is an electrically conducting rotatable device.

According to one embodiment the electrically conducting movable device is a slip ring.

According to one embodiment the electrical device is an induction motor.

According to one embodiment the electrically conducting movable device is a commutator.

According to one embodiment the electrical device is a DC motor.

Generally, all terms used in the claims are to be interpreted according to their ordinary meaning in the technical field, unless explicitly defined otherwise herein. All references to "a/an/the element, apparatus, component, means, etc. are to be interpreted openly as referring to at least one instance of the element, apparatus, component, means, etc., unless explicitly stated otherwise.

BRIEF DESCRIPTION OF THE DRAWINGS

The specific embodiments of the inventive concept will now be described, by way of example, with reference to the accompanying drawings, in which.

DETAILED DESCRIPTION

The inventive concept will now be described more fully hereinafter with reference to the accompanying drawings, in which exemplifying embodiments are shown. The inventive concept may, however, be embodied in many different forms and should not be construed as limited to the embodiments set forth herein; rather, these embodiments are provided by way of example so that this disclosure will be thorough and complete, and will fully convey the scope of the inventive concept to those skilled in the art. Like numbers refer to like elements throughout the description.

Figure 1A:
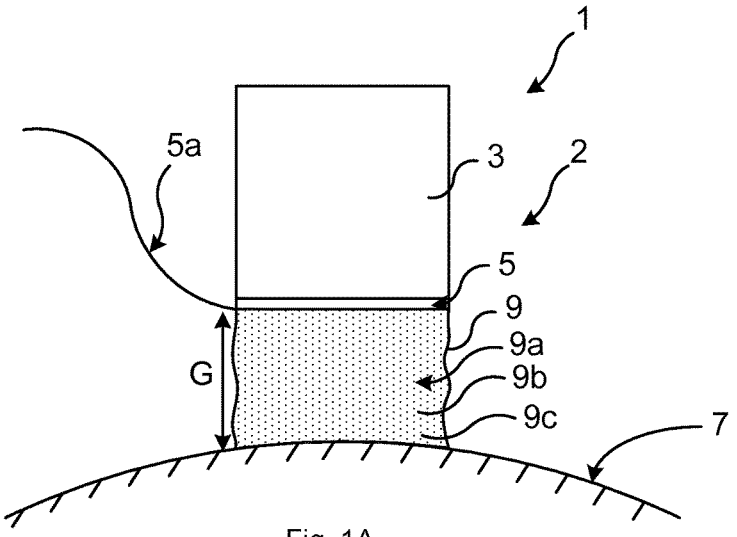
FIG. 1A schematically depicts a first example of a cross-sectional view of an electrical device.

FIG. 1*a* schematically shows an example of an electrical device 1. The electrical device may for example be an electrical motor such as a DC motor or a slip ring motor. A number of components of the electrical device 1, such as stator and rotor in the case the electrical device 1 is an electrical motor, are not shown in order to maintain a clear illustration and thus facilitating the understanding of this presentation.

The electrical device 1 comprises an electrode arrangement 2 comprising a magnet 3, an electrode 5, and an electrically conducting movable device 7, which is movable relative to the electrode 5. The electrode 5 is connectable to a power source via an electrical conductor 5*a*. The magnet 3 may be a permanent magnet or an electromagnet, and is fixed relative to the electrode 5. The electrode arrangement 2 is arranged distanced from the electrically conducting movable device 7 whereby a gap G is formed between the electrode arrangement 2 and the electrically conducting movable device 7. According to the example in FIG. 1*a*, the gap G is formed between the electrode 5 and the electrically conducting movable device 7.

The electrically conducting movable device 7 is according to the example in FIG. 1 an electrically conducting rotatable device arranged to rotate around a rotational axis extending longitudinally through the centre of the electrically conducting movable device 7. In particular, the electrically conducting movable device 7 is rotatable relative to the electrode arrangement 2. The electrically conducting movable device 7 is rotationally symmetric, according to one variation preferably essentially cylindrical. The electrically conducting movable device 7 may for example be arranged to transmit current to windings of a rotor. The electrically conducting movable device 7 may for example be made of metal, for instance copper and/or comprise a conducting alloy defining its external surface. The electrically conducting movable device 7 may for example be a commutator of DC motor or a slip ring of a slip ring motor. According to another variation, the electrical device may be a linear motor, wherein the electrically conducting movable device is arranged to move with a linear motion relative to the electrode arrangement.

The electrical device 1 comprises a suspension 9 which comprises a liquid 9*a*, a plurality of magnetic particles 9*b* dispersed in the liquid 9*a* and a plurality of non-magnetic electrically conducting particles 9*c* dispersed in the liquid 9*a*. The suspension 9 may according to one variation have a magnetic susceptibility which is non-zero. According to one variation, the magnetic particles 9*b* are smaller in size than the non-magnetic electrically conducting particles 9*c*. In particular, the non-magnetic electrically conducting particles 9*c* are at least an order of magnitude larger in size than the magnetic particles 9*b*. To this end, the diameter of any non-magnetic electrically conducting particle 9*c* may be at least an order of magnitude larger than the diameter of any magnetic particle 9*b*. The non-magnetic electrically conducting particles 9*c* may be micrometer sized and the magnetic particles 9*b* may be nanometer sized. The magnetic particles 9*b* may for example have a diameter in the range 0.1 nanometer to 800 nanometer. The magnetic particles should preferably be small enough to avoid sedimentation due to gravity when submersed in the liquid. Such magnetic particles may be synthesized by chemical vapour deposition, physical vapour deposition, electrolysis, sol-gel technology or by a reverse micelle colloidal reaction. The non-magnetic electrically conducting particles 9*c* may for example have a diameter in the range 1 micrometer to 100 micrometer.

The magnetic particles 9*b* may for example consist of one of the following, a ferromagnetic material such as a metal like nickel, iron, cobalt, a rare earth metal such as a neodymium or samarium or a magnetic metal oxide, nitride, carbide or boride. According to one variation the non-magnetic electrically conducting particles 9*c* consist of diamagnetic material, for example silver, copper, gold, aluminium, or conducting ceramic particles such as titanium nitride.

The non-magnetic electrically conducting particles 9*c* have an electric conductivity greater than the electric conductivity of a ferromagnetic material, and a higher electric conductivity than the magnetic particles 9*b*. The non-magnetic electrically conducting particles 9*c* have an electric conductivity greater than $1.00*10^7$ S/m, preferably greater than $1.40*10^7$ S/m, at room temperature, i.e. at 20° C.

The liquid 9*a* is preferably non-corrosive and has low viscosity, for example not higher than the viscosity of water at the temperature of operation of the suspension 9. According to one embodiment the liquid 9*a* may be an oil such as a transformer oil, or water. The liquid 9*a* and the magnetic particles 9*b* may according to one variation form a ferrofluid. A ferrofluid is a liquid with dispersed magnetic nanoparticles. The particles are so small that the Brownian motion prevents them from agglomerating, even in a strong magnetic field.

According to the example in FIG. 1*a*, the suspension 9 is in physical contact with and extends between the electrode 5 and the electrically conducting movable device 7 in the gap G. The magnet 3 is arranged to provide a magnetic field H between the electrode 5 and the electrically conducting movable device 7 through the suspension 9. The magnet 3 is positioned such that some magnetic field lines intersect both the electrode 5 and the electrically conducting movable device 7. The non-magnetic electrically conducting particles 9*c* thereby align along the magnetic field lines between the electrode 5 and the electrically movable device 7. A closed circuit between the electrically conducting movable device 7 and the power source may thus be obtained enabling current to flow between the electrode 5 and the electrically conducting movable device 7.

According to the example shown in FIG. 1*a*, the electrode is arranged between the magnet 3 and the suspension 9. The suspension 9 is thus not in mechanical contact with the magnet. According to another variation the suspension could be arranged between and in mechanical contact with the magnet and the electrically conducting movable device, and the electrode could be arranged in mechanical contact with the magnet but without mechanically contacting the suspension. Current could thereby flow from the electrode to the suspension and thus to the electrically conducting movable device through the magnet.

As shown in FIG. 1*a* the suspension 9 could be arranged only in the space defined by the gap G. This could be obtained for example by applying the suspension onto the electrode 5. With a sufficient magnetic field strength the magnet 3 would be able to retain the suspension between the electrically conducting movable device 7 and the magnet 3.

Figure 1B:
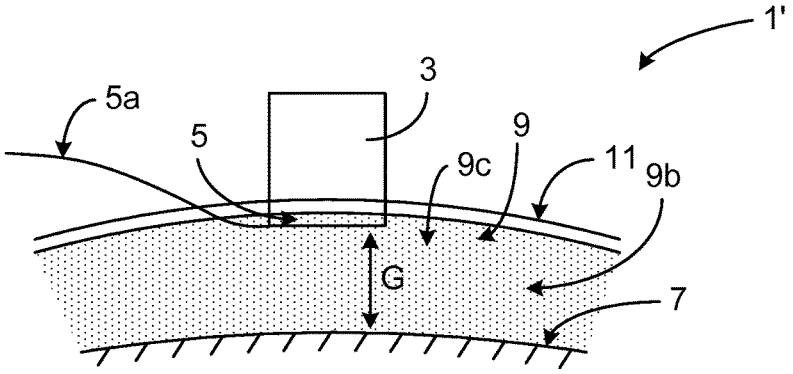
FIG. 1B schematically depicts a first example of a cross-sectional view of an electrical device.

FIG. 1*b* shows another example of an electrical device. Electrical device 1' is essentially identical to electrical device 1 except that electrical device 1' comprises a container 11 enclosing the electrically conducting movable device 7 and the suspension 9. The electrically conducting movable device 7 may hence be submerged in the suspension 9. In particular, the suspension 9 is arranged between the electrode 5 and the electrically conducting movable device 7. In the same manner as described above, the magnet 3 is arranged to provide a magnetic field through the suspension 9, between the electrode 5 and the electrically conducting movable device 7 such that the non-magnetic electrically conducting particles 9*c* align along the magnetic field lines and enable current transportation between the electrode 5 and the electrically conductive movable device 7. The electrical device 1' may further comprise a seal arrangement for sealing the suspension 9 within the container 11.

Figure 2:
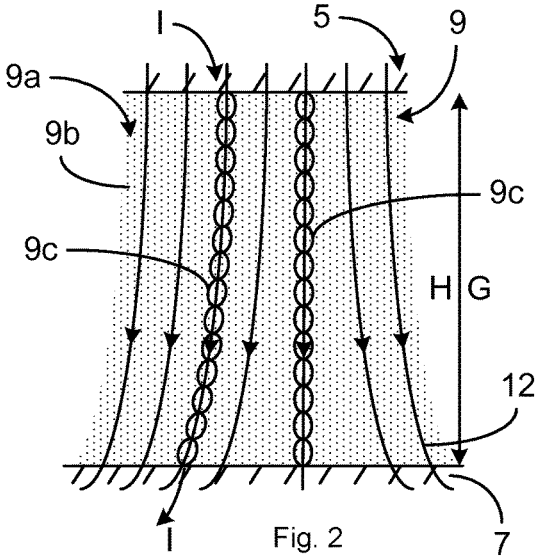
FIG. 2 schematically depicts an enlarged view of a suspension extending between the between an electrode and an electrically conducting movable device of an electrical device.

The cooperative functioning of the components of the electrical device 1, 1' presented in FIGS. 1*a-b* will now be described in more detail with reference to FIG. 2. It should be noted that the magnetic particles 9*b*, the non-magnetic electrically conducting particles 9*c* and the distance between the electrode 5 and the electrically conducting movable device 7 are not to scale. The magnet 3, which may be a permanent magnet or an electromagnet, not shown in FIG. 2, provides an external magnetic field H through the suspension 9. Due to the magnetic field H which has magnetic field lines 12 extending through the entire gap G between the magnet 3 and the electrically conducting movable device 7, the non-magnetic electrically conducting particles 9*c* align parallel to the magnetic field lines 12, thus forming electrically conductive paths. The non-magnetic electrically conducting particles 9*c* are hence aligned throughout the entire gap G in the radial direction. Due to their ability to conduct current, a current I may flow through the suspension 9 between the electrode 5 and the electrically conducting movable device 7. Since they are comparably large and soft relative to the magnetic particles 9*b*, the contact resistance may be reduced. Moreover, due to their higher electrical conductivity losses may further be reduced.

In variations utilising an electromagnet, a liquid switch may be obtained with current paths provided by the non-magnetic electrically conducting particles when a magnetic field is applied through the suspension in the radial direction. When the electromagnet is de-energised the current paths disappear and no current is able to flow from the electrode to the electrically conducting movable device.

According to one variation, the suspension consists of three components, namely the liquid, the magnetic particles dispersed in the liquid and the non-magnetic electrically conducting particles dispersed in the liquid.

The electrical device presented herein provides a more efficient, low friction electrical contact between a fixed part and a movable part. The electrical device may beneficially be utilised in low voltage and medium voltage applications, for example in electrical motors such as DC motors and induction motors comprising a slip ring, such as slip ring motors.

The inventive concept has mainly been described above with reference to a few examples. However, as is readily appreciated by a person skilled in the art, other embodiments than the ones disclosed above are equally possible within the scope of the inventive concept, as defined by the appended claims.

The invention claimed is:

1. An electrical device comprising:

an electrode arrangement comprising a magnet and an electrode, an electrically conducting movable device, movable relative to the electrode arrangement and spaced apart from the electrode arrangement, whereby a gap is formed therebetween, and a suspension comprising a liquid, a plurality of magnetic particles dispersed in the liquid and a plurality of non-magnetic electrically conducting particles dispersed in the liquid, which non-magnetic electrically conducting particles have higher electric conductivity than the magnetic particles, wherein the suspension extends between the electrically movable device and the electrode arrangement in the gap, and wherein the magnet is arranged to provide a magnetic field through the suspension to thereby align the non-magnetic electrically conducting particles between the electrode arrangement and the electrically conducting movable device to obtain an electrical connection between the electrode arrangement and the electrically conducting movable device.

2. The electrical device as claimed in claim 1, wherein the magnetic particles are smaller in size than the non-magnetic electrically conducting particles.

3. The electrical device as claimed in claim 1, wherein the magnetic particles are at least an order of magnitude smaller in size than the non-magnetic electrically conducting particles.

4. The electrical device as claimed in claim 1, wherein the non-magnetic electrically conducting particles are micrometer-sized.

5. The electrical device as claimed in claim 1, wherein the non-magnetic electrically conducting particles are made of one of the group of copper, silver, gold, aluminium, and conducting ceramic.

6. The electrical device as claimed in claim 1, wherein the liquid is an oil or water.

7. The electrical device as claimed in claim 1, wherein the magnetic particles are nanometer-sized.

8. The electrical device as claimed in claim 1, wherein the liquid and the magnetic particles form a ferrofluid.

9. The electrical device as claimed in claim 1, wherein the suspension has a magnetic susceptibility which is non-zero.

10. The electrical device as claimed in claim 1, comprising a container enclosing the electrically conducting movable device and the suspension.

11. The electrical device as claimed in claim 1, wherein the electrically conducting movable device is an electrically conducting rotatable device.

12. The electrical device as claimed in claim 11, wherein the electrically conducting movable device is a slip ring.

13. The electrical device as claimed in claim 1, wherein the electrical device is an induction motor.

14. The electrical device as claimed in claim 1, wherein the electrically conducting movable device is a commutator.

15. The electrical device as claimed in claim 1, wherein the electrical device is a DC motor.

* * * * *